US006969815B1

(12) United States Patent
Lu

(10) Patent No.: US 6,969,815 B1
(45) Date of Patent: Nov. 29, 2005

(54) KEYBOARD KEY CAPABLE OF LOWERING ITS OVERALL HEIGHT

(75) Inventor: Tien-Min Lu, Hsin-Tien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 10/995,260

(22) Filed: Nov. 24, 2004

(51) Int. Cl.[7] ..... H01H 13/70
(52) U.S. Cl. ..... 200/345; 200/5 R; 200/520; 400/491
(58) Field of Search ..... 200/5 R, 341–345, 200/520–522, 512, 5 A; 400/490, 491, 491.2, 400/495.1

(56) References Cited

U.S. PATENT DOCUMENTS 5,386,091 A * 1/1995 Clancy ..... 200/517
5,442,152 A * 8/1995 Huang ..... 200/345
5,990,435 A * 11/1999 Chao ..... 200/517
6,184,481 B1 * 2/2001 Chen ..... 200/5 A
6,310,308 B1 * 10/2001 Watson et al. ..... 200/520
6,743,993 B1 * 6/2004 Clark et al. ..... 200/314

* cited by examiner

*Primary Examiner*—Richard K. Lee
(74) *Attorney, Agent, or Firm*—Birch, Stewart, Kolasch & Birch, LLP

(57) ABSTRACT

A keyboard key capable of lowering its overall height, which comprises a key cap body and a key cap base being coupled to the keyboard and disposed at the areas of four corners correspondingly having a displacing pillar and elevating groove, and an accommodating section of an electrically conductive cap body disposed at the corresponding central position of the key cap base and the key cap body, and a fixing section and a positioning section coupled to the key cap body and the key cap base respectively, and the displacing pillar and elevating groove are disposed separately at the four corners to reduce the moment of any point of the key cap body pressing the electrically conductive cap body in order to achieve the purposes of effectively lowering the overall height of the key and making the keyboard thin.

3 Claims, 6 Drawing Sheets

KEYBOARD KEY CAPABLE OF LOWERING ITS OVERALL HEIGHT

FIELD OF THE INVENTION

The present invention generally relates to a keyboard key capable of lowering its overall height, more particularly to a keyboard key comprised of a key cap base, a key cap body and an electric conductive cap body.

BACKGROUND OF THE INVENTION

The present keyboard keys used for entering data to computers are divided into the vertical elevating type key and the bridge type key, and the bridge type key adopts two cross movable stands to shift the key up and down by compressing the key vertically. Compared with the vertical elevating type key, the overall height of the bridge type key is lower. The reason for the overall height of the vertical elevating type key being higher than that of the bridge type key resides on that the vertical elevating key as shown in FIG. 1 is coupled to the keyboard, and the key comprises a key cap base, a key cap body coupled to the key cap base and displaced vertically on the key cap base, and an electrically conductive cap body disposed on the key cap base for providing a resilient force to the key cap body, and the elevating mode makes use of a pressing pillar being disposed at the central position of the key cap body and compressed onto the electrically conductive cap body to store resilience, or being released to resume the original position of the key cap body by the resilient force from the electrically conductive cap body.

However, when a user enters data from the keys, the user usually does not exert a force at the central position of the key cap body all the time. If the force is exerted on the area of the four corners of the key cap body, the height of the pressing pillar of the key cap body must be substantially equal to the moment at the four corners of the key cap body with respect to the center to assure the force of each stroke is pressed onto the key. The height of the vertical elevating type key depends on the size of the key cap body and cannot be as thin as the bridge type key.

SUMMARY OF THE INVENTION

The primary objective of the present invention is to overcome and avoid the foregoing shortcomings. This invention provides a way of reducing moment exerted on the key cap body to make the vertical elevating key type keyboard thin. The present invention comprises a key cap body and a key cap base being coupled to the keyboard and disposed in the areas of four corners respectively having a displacing pillar and elevating groove, and an accommodating section of an electrically conductive cap body disposed at the corresponding central position of the key cap base and the key cap body, and a fixing section and a positioning section coupled to the key cap body and the key cap base respectively, and the displacing pillar and elevating groove are disposed separately at the four corners to reduce the moment of any point at the key cap body pressing the electrically conductive cap body in order to achieve the purposes of effectively lowering the overall height of the key and making the keyboard thin.

DETAILED DESCRIPTION OF THE PREFERRED EMBODIMENTS

To make it easier for our examiner to understand the objective of the present invention, its structure, innovative features, and performance, we use a preferred embodiment together with the attached drawings for a detailed description of the invention.

Figure 1:
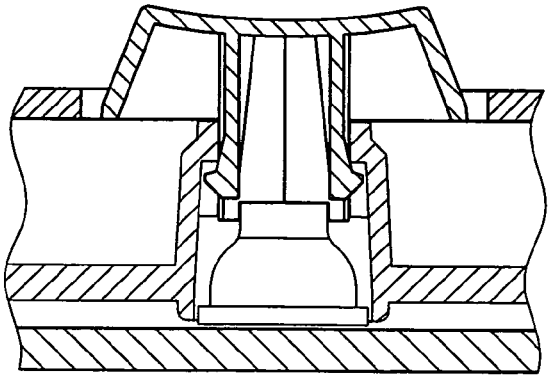
Fig.1 PRIOR ART
FIG. 1 is a cross-sectional view of a prior-art keyboard key.
Figure 2:
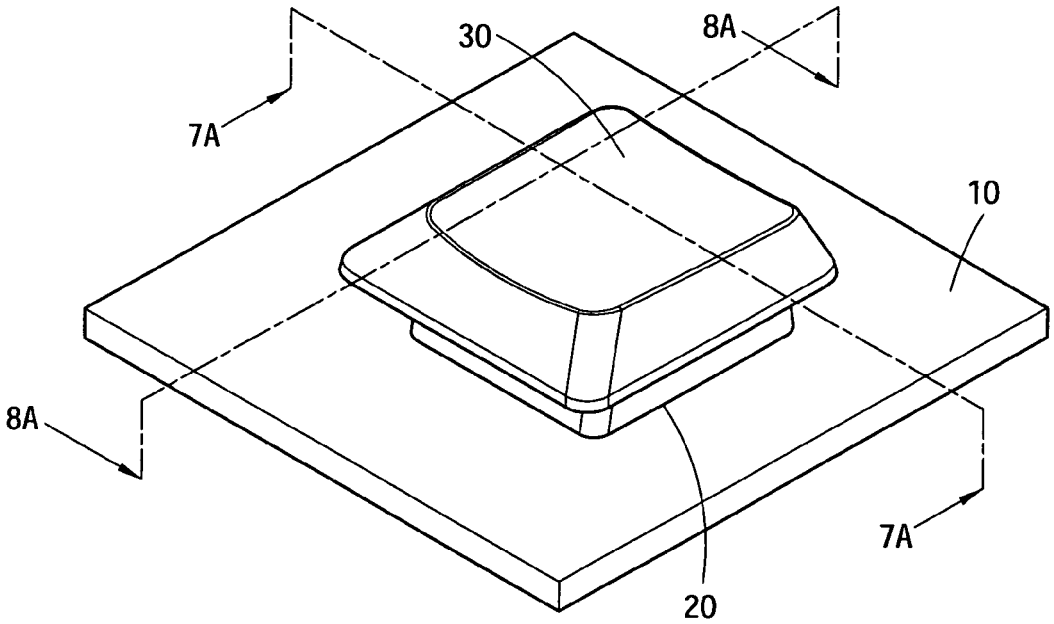
FIG. 2 is a perspective view of the present invention.
Figure 3:
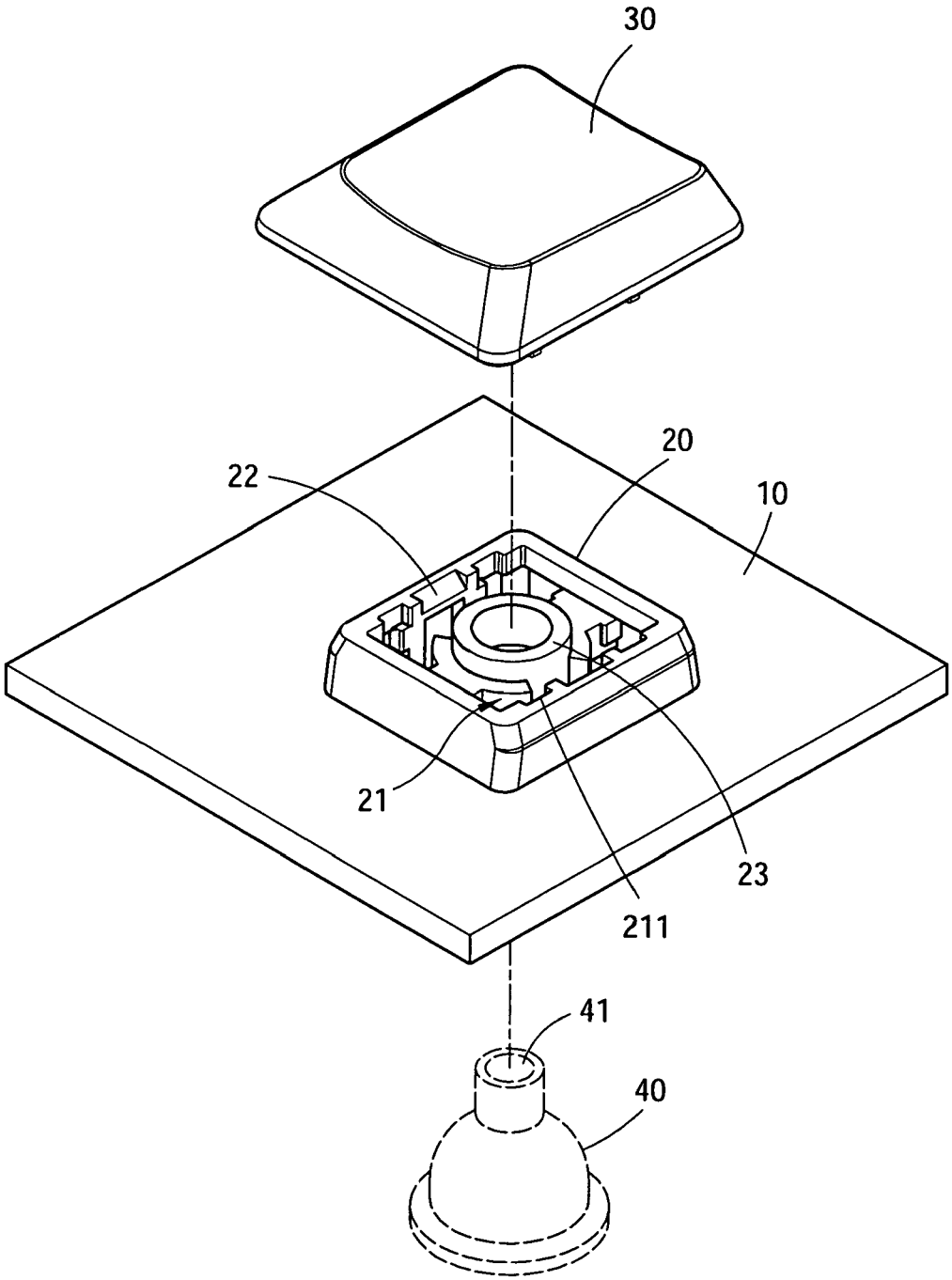
FIGS. 3 and 4 are exploded views of the present invention.
Figure 4:
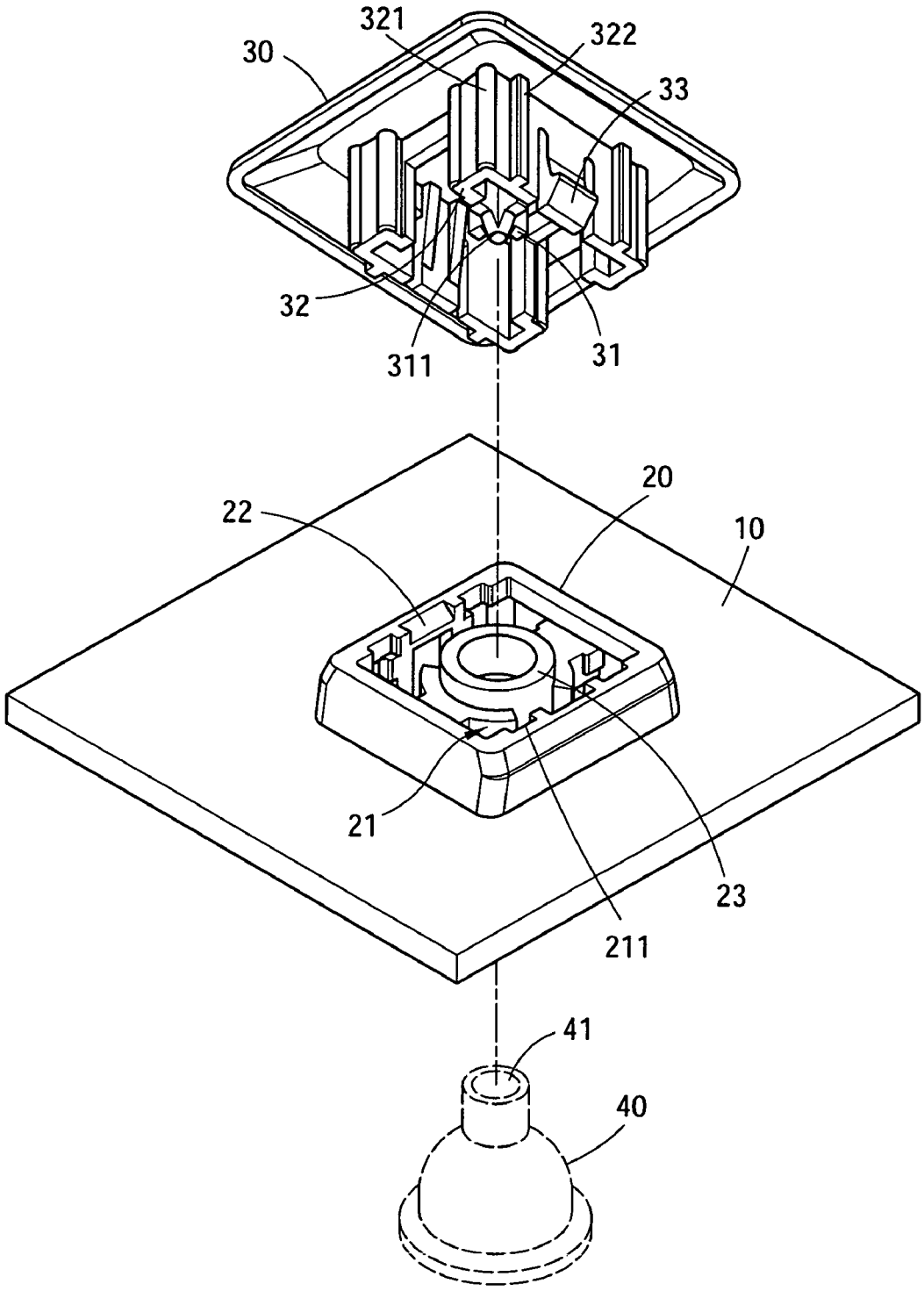
Figure 5:
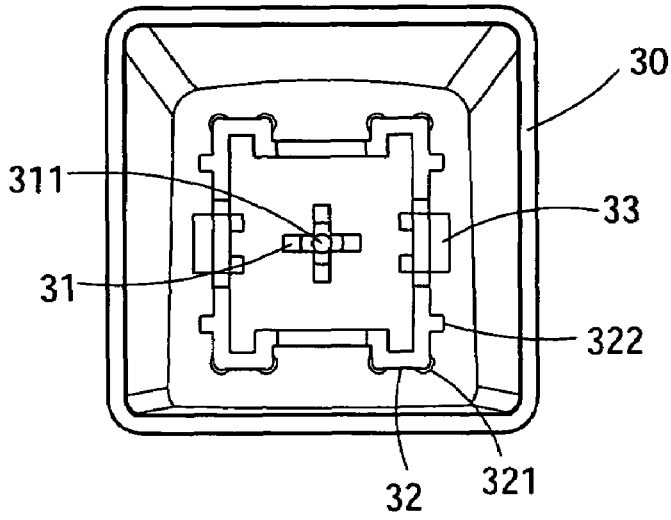
FIG. 5 is a bottom view of the key cap body of the present invention.
Figure 6:
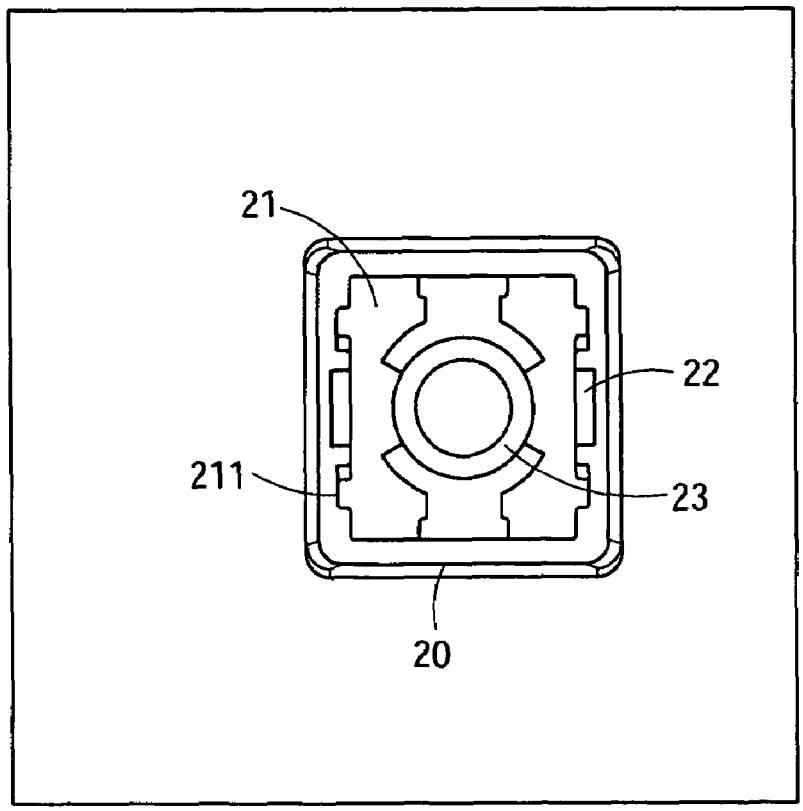
FIG. 6 is a top view of the key cap base of the present invention.

Please refer to FIGS. 2 to 6 for the present invention. The key of a keyboard 10 capable of lowering its overall height according to the present invention, and the key comprises a key cap base 20; a key cap body 30 being coupled to the key cap base 20 and displaced vertically on the key cap base 20; and an electrically conductive key cap body 40 being disposed on the key cap base 20 for providing a resilient force for the key cap body 30, wherein the key cap body 30 and the key cap base 20 being disposed at the areas of four corners and having a displacing pillar 32 and an elevating groove 21 respectively; the displacing pillar 32 at its periphery comprises two sliding tracks 321 and a positioning track 322 being disposed in three vertical directions and a positioning groove 211 being disposed in the elevating groove 21 and corresponsive to the positioning track 322; an accommodating section 23 being disposed at the central position of the key cap base 20 and the key cap body 30 for accommodating the electrically conductive cap body 40, and the electrically conductive cap body 40 comprises a recession 41 being disposed at its top and a limit section 311 being extended from the central pillar 31 into the recession 41 for positioning the electrically conductive cap body 40, and a fixing section 33 and a positioning section 22 being disposed on the key cap body 30 and the said key cap base 20 respectively.

Figure 7A:
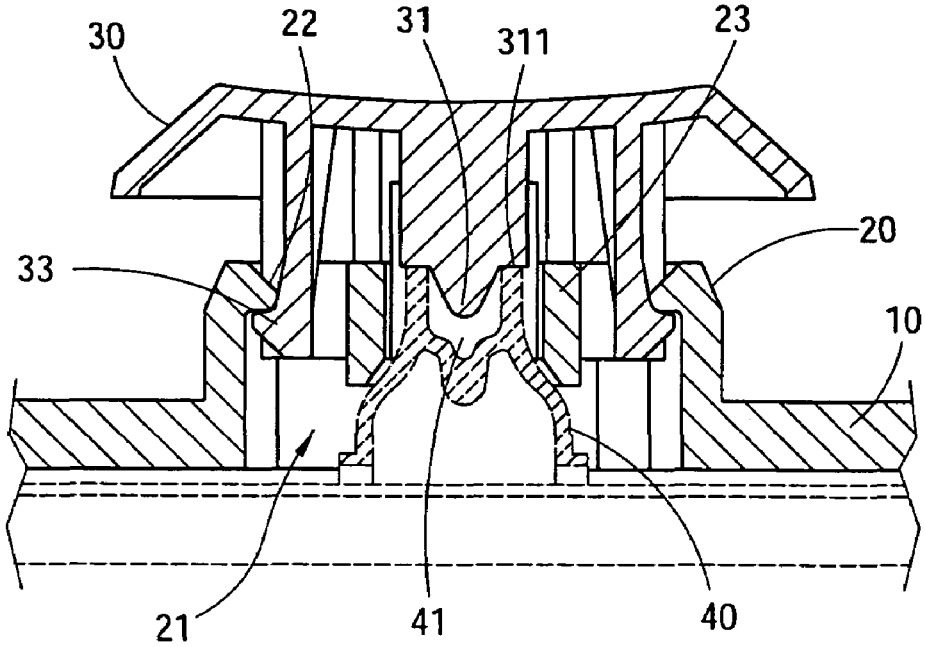
FIGS. 7A and 7B are cross-section views of the movement along 7A—7A as depicted in FIG. 2.
Figure 7B:
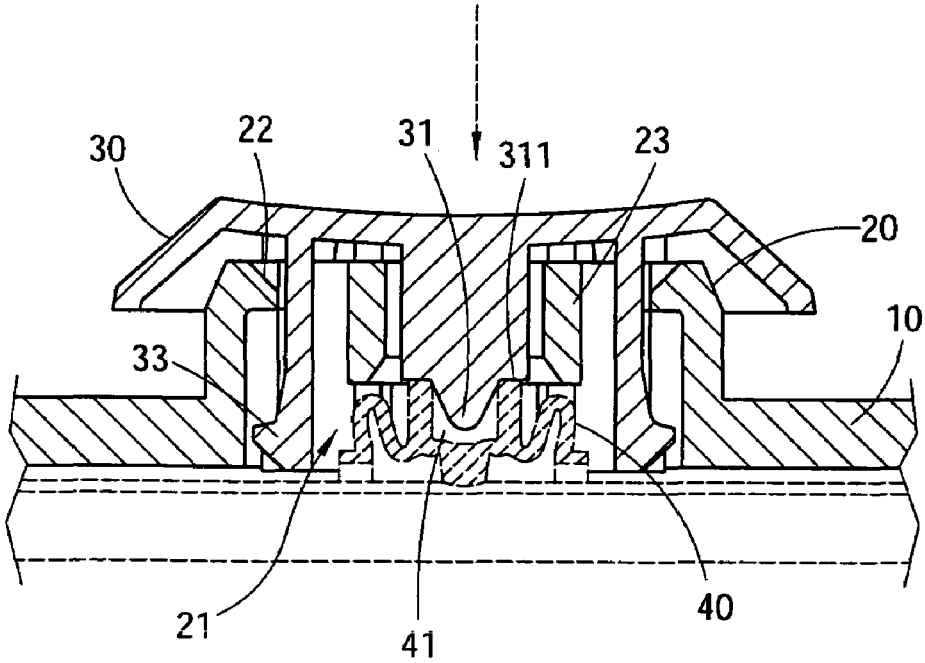
Figure 8A:
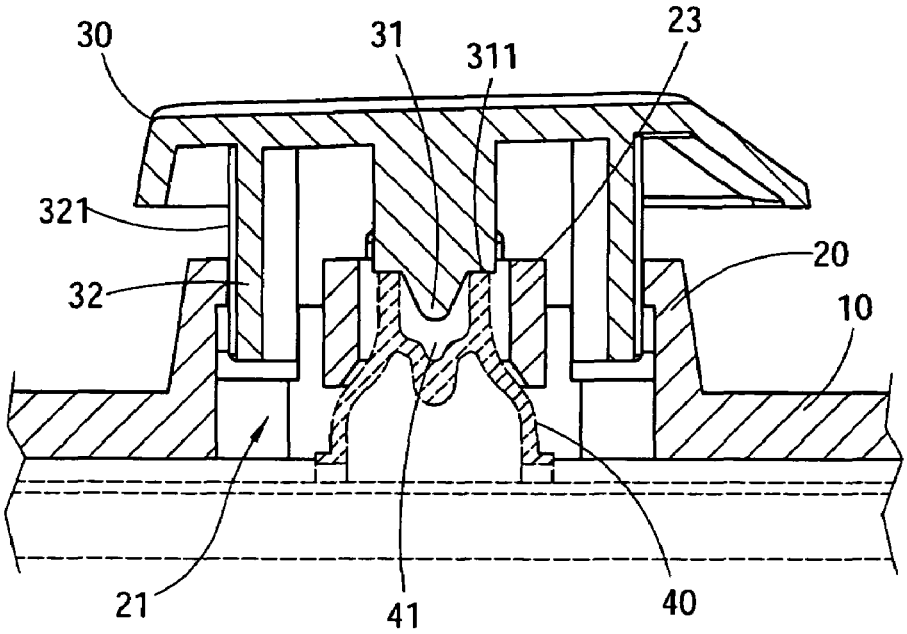
FIGS. 8A and 8B are cross-section views of the movement along 8A—8A as depicted in FIG. 2.
Figure 8B:
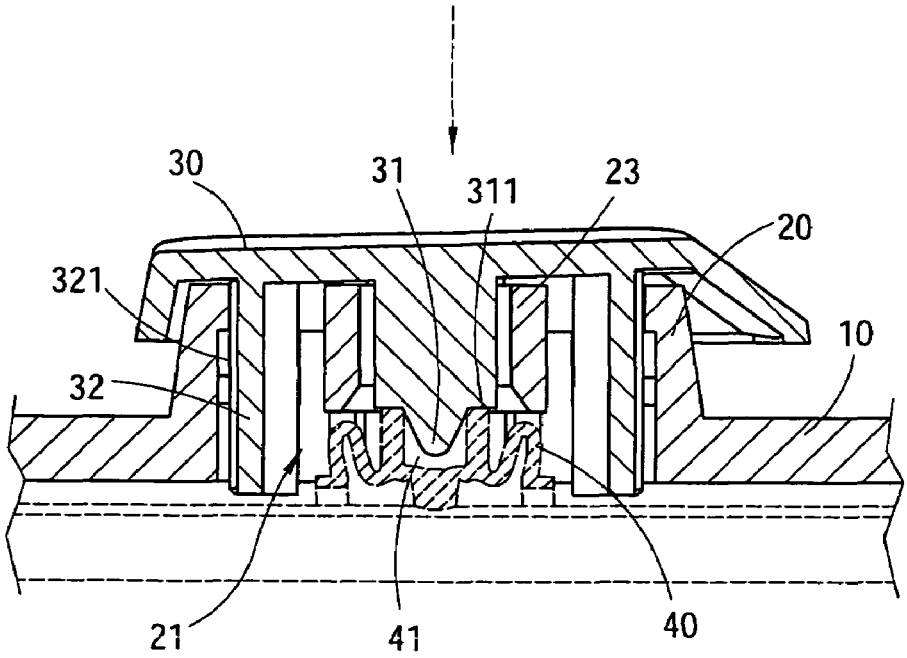

Please refer to FIGS. 7A, 7B, 8A and 8B for the cross-sectional views of the movements according to the present invention. In the figures, when a user enters data from the keyboard 10 of the present invention, regardless of the force exerted on any position on the surface of the key cap body 30, the central pillar 31 of the key cap body 30 and the displacing pillars 32 at the four corners can reduce the moment with respect to the point of exerting force. Therefore, a user can press the key by vertically displacing a sliding track 321 and a positioning track 322 of the displacing pillar 32 in the elevating groove 21 and the positioning groove 211. When the key cap body 30 displaces downward, the central pillar 31 compresses the electrically conductive cap body 40 to store resilient force, and when the user releases the key, the resilience of the electrically conductive cap body 40 drives the central pillar 31 together with the key cap body 30 to resume its original position. During the resuming process, a fixing section 33 and a positioning section 22 form a restriction to prevent the key cap body 30 from falling off due to the excessive resilience of the electrically conductive cap body 40.

In view of the description above, the moment is reduced, and the heights of the central pillar 31, the displacing pillar 32 and the accommodating section 23 for installing the electrically conductive cap body 40 can be greatly lowered, and thus making the keyboard 10 thinner.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A keyboard key capable of lowering its overall height, being coupled on a keyboard, and said key comprising a key cap base; a key cap body being coupled to said key cap base and displaced vertically on said key cap base; and an electrically conductive key cap body being disposed on said key cap base for providing a resilient force for said key cap body, characterized in that said key cap body and said key cap base being disposed at the areas of four corners and having a displacing pillar and an elevating groove respectively and an accommodating section being disposed at the central position of said key cap base and said key cap body for accommodating said electrically conductive cap body and a central pillar for pressing said electrically conductive cap body and a fixing section and a positioning section being disposed on said key cap body and said key cap base respectively.

2. The keyboard key capable of lowering its overall height of claim 1, wherein said displacing pillar at its periphery comprises two sliding tracks and a positioning track being disposed in three vertical directions and a positioning groove being disposed in said elevating groove and corresponsive to said positioning track.

3. The keyboard key capable of lowering its overall height of claim 1, wherein said electrically conductive cap body comprises a recession being disposed at its top and a limit section being extended from said central pillar into said recession for positioning said electrically conductive cap body.

* * * * *